United States Patent [19]

Morata

[11] Patent Number: 4,727,523

[45] Date of Patent: Feb. 23, 1988

[54] HAND SETTING MECHANISM FOR A TIMEPIECE

[75] Inventor: Philippe Morata, Bienne, Switzerland

[73] Assignee: ETA SA Fabriques d'Ebauches Schild-Rust-Strasse, Granges, Switzerland

[21] Appl. No.: 892,238

[22] Filed: Aug. 4, 1986

[30] Foreign Application Priority Data

Aug. 20, 1985 [CH] Switzerland ..... 03574/85

[51] Int. Cl.[4] ..... G04B 27/04; G04B 29/00

[52] U.S. Cl. ..... 368/191; 368/319

[58] Field of Search ..... 368/184, 185, 190–195, 368/319–321

[56] References Cited

U.S. PATENT DOCUMENTS 4,274,152 6/1981 Ikegami ..... 368/191
4,447,163 5/1984 Tsukada et al. ..... 368/191

FOREIGN PATENT DOCUMENTS 22108 9/1901 Switzerland .
2086620 5/1982 United Kingdom ..... 368/191

*Primary Examiner*—Vit W. Miska
*Attorney, Agent, or Firm*—Griffin, Branigan & Butler

[57] ABSTRACT

A hand setting mechanism including a stem and a sliding pinion slaved to one another by means of a setting lever and a yoke. The sliding pinion is driven in rotation by means of a slit with which it is provided and which cooperates with two flattened surface borne on the stem. The sliding pinion is freely engaged in an orifice pierced in the base plate and is provided with a circular hole which serves as a bearing for a pivot at the end of the stem.

2 Claims, 4 Drawing Figures

HAND SETTING MECHANISM FOR A TIMEPIECE

This invention concerns a hand setting mechanism for a timepiece of the type comprising a base plate supporting a movement, said mechanism including a stem arranged to be manipulated from the timepiece exterior by means of a crown, said stem being adapted to assume at least two latched axial positions one of which is neutral and another active, a sliding pinion coaxial with the stem and sliding thereon, said sliding pinion being provided with teeth adapted to mesh with a setting wheel, the stem and the sliding pinion being respectively provided with male and female portions of non-circular cross-section fitting into one another so as to drive the sliding pinion in rotation when the stem is rotatively manipulated, and a system of setting lever and yoke for slaving the sliding pinion to the stem and putting into mesh said teeth with said setting wheel when said stem is placed in its active position.

BACKGROUND OF THE INVENTION

A hand setting mechanism corresponding to the general definition which has just been given is well known in the state of the art and is shown for instance in the Swiss patent document No. 462.220. In this document, the non-circular male portion borne by the stem consists of a squared part which may slide in a hole of corresponding form cut into the sliding pinion. As one may see from the cross-section of the figures accompanying the cited patent, the external diameter of the sliding pinion is visibly greater than the diameter of the stem and thus takes up space in the thickness of the timepiece. As may be likewise seen from the same figures, the stem terminates following the squared portion by a circular pivot which turns and slides in an orifice arranged in the base plate. This manner of fabrication leads to a non-negligible space requirement in the sense of the diameter of the base plate which finally brings about an increase in the overall diameter of such base plate.

To overcome the first mentioned difficulty and diminish the thickness of the movement, calibers have already been constructed in which the sliding pinion exhibits an outer diameter of the same order as the diameter of the stem. In order to arrange this, there is cut into the end of the stem a non-circular male portion including two flats engaging in a slit cut into the sliding pinion. This solution, in addition to the advantage which it brings about of reducing the diameter of the said pinion, enables an easy fabrication since the slit is obtained by a simple passage of the milling cutter. Since in the proposed solution, the end of the stem proximate the movement lacks a pivot sliding in a bearing, the sliding pinion has been guided in an orifice cut into the base plate. This orifice however has very thin walls which may be damaged by the flats on the stem if said stem is not sufficiently well guided. The difficulty has been overcome by guiding the stem along a path of greater length at its entry into the base plate on the crown side thereof with the attendant difficulty of occupying at least as much space as if the stem were provided with a pivot sliding in the base plate as was the case in the above cited patent.

To overcome this difficulty and provided a movement the planar space requirement of which is reduced as much as possible, one may employ an arrangement as set forth hereinafter.

SUMMARY OF THE INVENTION

The invention thus provides an arrangement as set forth in the opening paragraph of this description and wherein the stem is engaged on the portion thereof proximate the crown in a first circular orifice cut into the base plate and is terminated on the end proximate the movement by a circular pivot engaged in a freely adapted to a hole exhibited by the sliding pinion, said sliding pinion being guided in a second circular orifice cut into the base plate.

Figure 1:
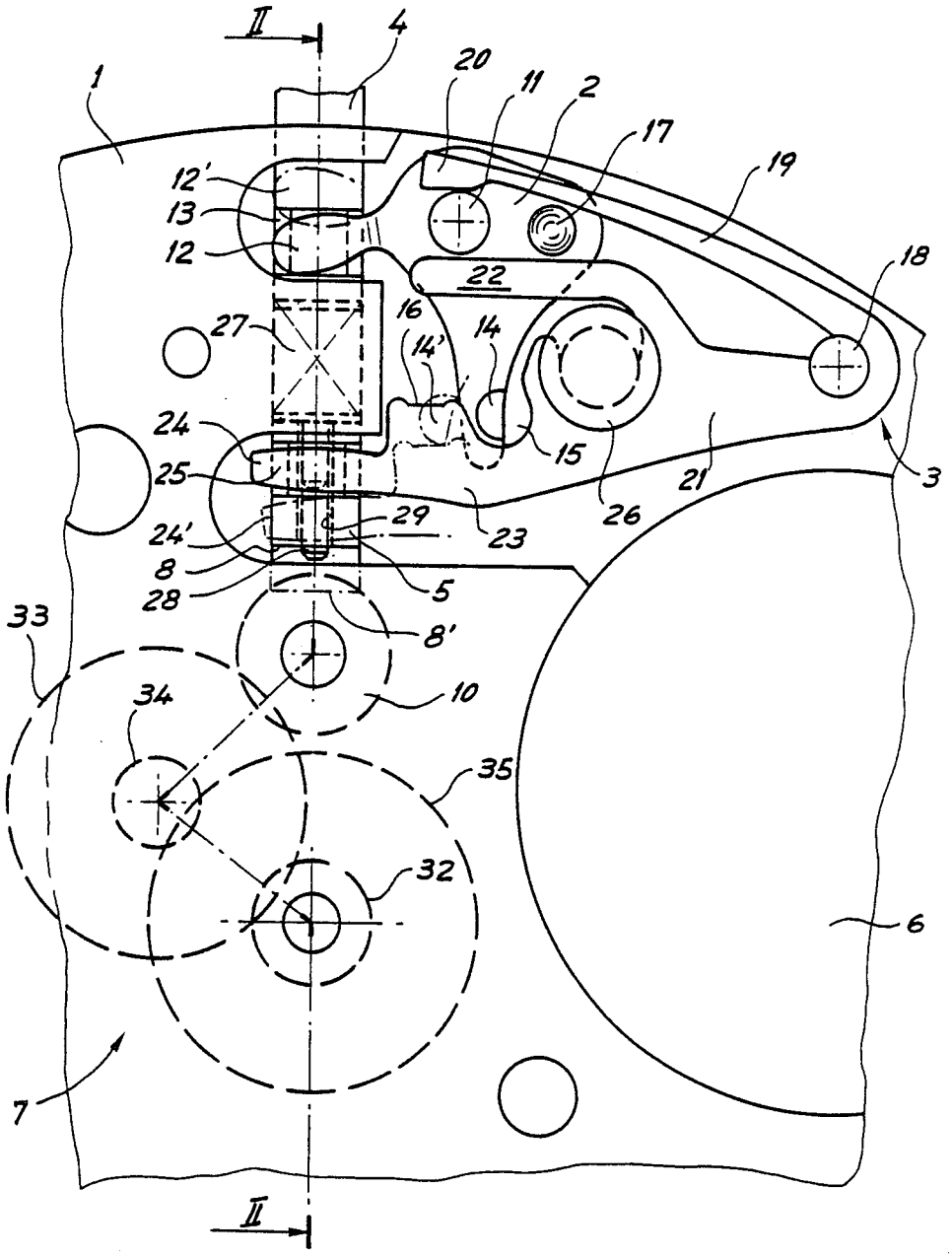
FIG. 1 is a plan view of the hand setting arrangement according to the invention.
Figure 3:
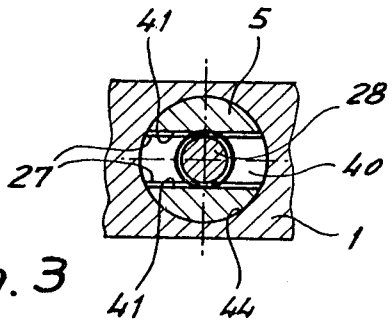

FIG. *2a* is a cross-section along line II—II of FIG. 1 when the stem is in the neutral pushed-in first setting;

FIG. *2b* is a cross-section according to line II—II of FIG. 1 when the stem is in the second active drawn out setting, and FIG. 3 is a cross-section along line III—III of FIG. *2b*.

DESCRIPTION OF THE PREFERRED EMBODIMENT

FIG. 1 is a plan view of the hand setting arrangement according to the invention. The time piece comprises a base plate 1, a setting lever 2 and a yoke 3 coupled respectively to a stem 4 and a sliding pinion 5, a housing 6 for a battery and a wheel train 7. The end 8 of the sliding pinion includes contrate teeth (designated by 9 in FIGS. *2a* and *2b*). In the drawn out setting of stem 4, the sliding pinion will mesh with a setting wheel 10 forming part of the wheel train 7. The setting lever 2 pivots about an axis 11. It includes a nose 12 engaged in a groove 13 cut in the stem 4. The setting lever further includes a stud 14 which cooperates with notches 15 and 16 which are provided on yoke 3. The indent 17 enables one to bring to bear a point in order to lift nose 12 thus permitting extraction of the stem from the movement. The yoke 3 is in the form of a V pivoting at 18. One of the arms 19 of the V is elastic and its end 20 is brought to bear on the axis 11 of the setting lever. The other branch 21 of yoke 3 comprises a first arm 22 intended to maintain the setting lever in a plane and a second arm 23 in which are cut notches 15 and 16. The second arm 23 ends with a beak 24 engaged in a groove 25 of the sliding pinion 5. Branch 21 of the yoke is maintained in place by a stud 26. The setting lever and the yoke are drawn in position for which the stem is in its neutral pushed-in setting. In this position stud 14 is latched in the groove 15 and the beak 24 maintains the sliding pinion towards the upper part of the figure which causes the end 8 of the said pinion to be disengaged from the setting wheel 10. There has been shown in broken lines the positions occupied by beak 24', the nose 12' and the stud 14' when the stem is in its active drawn out setting. In this position stud 14' comes to be latched into groove 16 and the end 8' of the sliding pinion comes into mesh with the setting wheel 10.

Stem 4 comprises a male portion of non-circular cross-section including two flats 27 engaged in a slit (not visible on FIG. 1) cut in the sliding pinion 5. According to the invention, stem 4 further includes at its end opposite the controlling crown (not shown) a pivot 28 engaged in a hole 29 of the sliding pinion 5. From FIG. 1 it will be understood how the mechanism of the setting lever and yoke operates in order to slave the sliding pinion to the stem, this mechanism being known to the prior art.

Figure 2A:
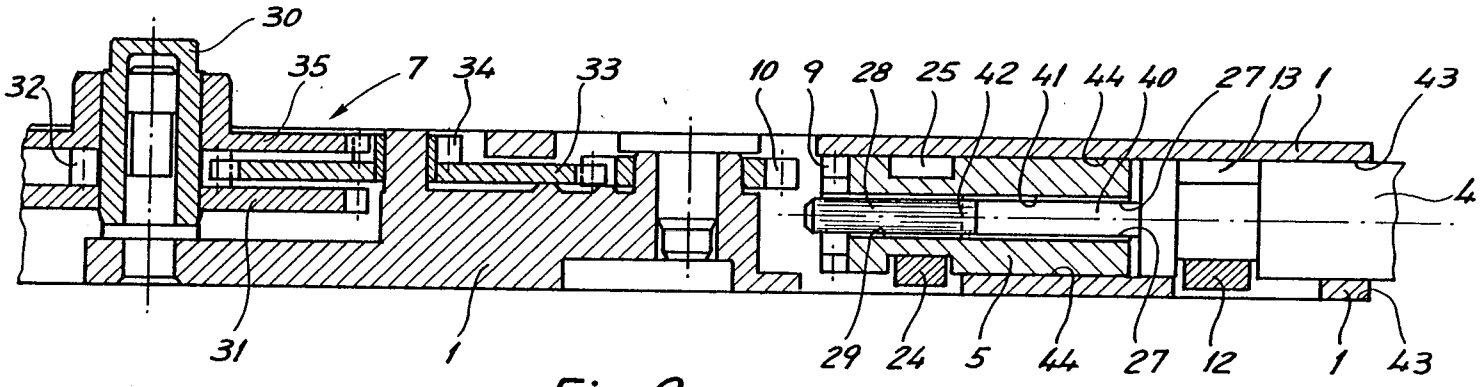
Figure 2B:
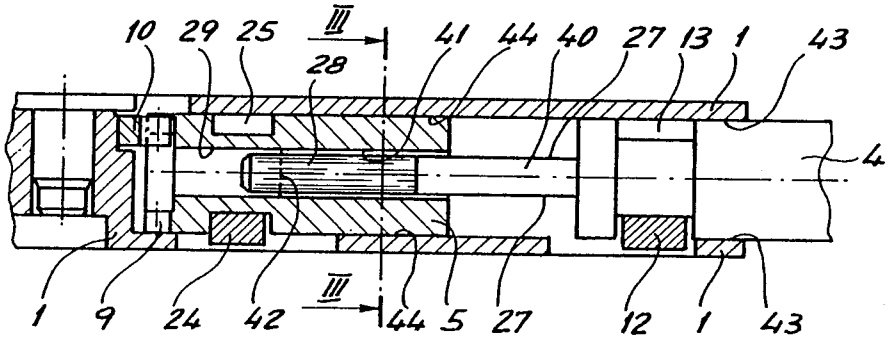

FIGS. 2*a* and 2*b* are cross-sections according to line II—II of FIG. 1. FIG. 2*a* shows in detail the wheel train 7 mentioned in respect of FIG. 1. Fixed to the cannon 30 which bears the minutes hand (not shown), there will be found the minutes wheel 31 which is driven by motor means. A pinion 32 fixed to the minutes wheel drives a dial train comprising wheel 33 and pinion 34. Pinion 34 drives in turn the cannon wheel 35 fixed to the hours hand (not shown). The dial train wheel 33 is in mesh with the setting wheel 10 on which may act the hand setting control via the contrate teeth 9. The hand setting system proper is shown on FIG. 2*a* when the stem is in the neutral pushed-in setting and in FIG. 2*b* when this stem is in the active drawn-out setting. The system exhibits a stem 4 operated by a crown (not shown). In the groove 13 of the stem 4, there is engaged nose 12 of the setting lever (see also FIG. 1). The stem continues with a male non-circular portion 40 which exhibits two flats 27 directed in the sense perpendicular to the drawing. This portion 40 is engaged in a slit 41 cut into the sliding pinion 5. Thus when the stem turns the sliding pinion turns therewith. The stem further comprises beyond portion 40 a circular pivot 28 which is engaged with a freely adapted to a hole 29 with which the sliding pinion is provided. Hole 29 stops at the dotted line referenced 42 from which begins slit 41. The sliding pinion 5 furthermore includes a groove 25 in which is engaged the beak 24 of the yoke 3 (see also FIG. 1).

As may be readily seen on FIGS. 2*a* and 2*b* stem 4 on the crown end is engaged in a first circular orifice 43 cut into the base plate 1. The same is likewise true of the sliding pinion 5 which is guided in a second circular orifice 44 cut in the base plate 1. Thus, thanks to pivot 28 of the stem engaged in hole 29 of the sliding pinion, the later being itself guided in the base plate and thanks to the orifice 43 in which the forward part of the stem is guided, all of stem 4 is perfectly guided on the interior of the base plate. In other words the stem remains aligned between two support bearings, the first being the orifice 43 guiding and centering the ste and the second being orifice 44 guiding and centering the sliding pinion, the latter itself serving as a bearing for the pivot provided at the end of the stem.

FIG. 3 is a cross-section along line III—III of FIG. 2*b*. It is seen that the sliding pinion is adjusted to the orifice 44 cut in base plate 1. Behind the pivot 28 may be distinguished the non-circular portion 40 borne by stem 4 as well as the flats 27 of this portion and the edges of slit 41 of the sliding pinion between which slide the flats 27.

The construction as described here by way of example is not limited to the employment of two flats 27 for stem 4. This could likewise be provided with a squared portion or any other non-circular form. In the same manner, the diameter of pivot 28 is shown as being equal to the distance which separates the two flats. It will be understood that this diameter could be smaller than the distance in question.

From the description hereinabove it will be understood the advantage which may be obtained from such a construction. Effectively, pivot 28 not being guided in a hole cut into the base plate as in the case of the prior art but in a hole forming part of the sliding pinion, itself guided in the base plate, considerable space is gained in the sense of the diametral spacial requirement of the time piece. Moreover, there is no longer a risk of damaging the base plate by the edges of the flats when the stem is driven in rotation since the stem remains permanently aligned in its housing.

What I claim is:

1. A hand setting mechanism for a timepiece of the type comprising a base plate supporting a movement, said mechanism including a stem arranged to be manipulated from the timepiece exterior by means of a crown, said stem being adapted to assume at least two latched axial positions one of which is neutral and another active, a sliding pinion coaxial with the stem and sliding thereon, said sliding pinion being provided with teeth adapted to mesh with a setting wheel, the stem and the sliding pinion being respectively provided with male and female portions of non-circular cross-section fitting into one another so as to drive the slidng pinion in rotation when the stem is rotatively manipulated, and a system of setting lever and yoke for slaving the sliding pinion to the stem and putting into mesh said teeth with said setting wheel when said stem is placed in its active position, said stem being engaged on the portion thereof proximate the crown in a first circular orifice cut into the base plate and being terminated on the end proximate the movement by a circular pivot following said male portion of non-circular cross-section, the diameter of said circular pivot being smaller than the extent of said non-circular cross-section of said male portion, said circular pivot being engaged in and freely adapted to a circular hole provided in the sliding pinion following said female portion, said sliding pinion being guided in a second circular orifice cut into the base plate.

2. A hand setting mechanism as set forth in claim 1 wherein the male portion of non-circular cross-section of the stem includes two flats engaged in a slit cut into the sliding pinion and wherein the diameter of the circular pivot is smaller than the distance separating the two flats.

* * * * *